US012178336B2

(12) United States Patent
Martin

(10) Patent No.: US 12,178,336 B2
(45) Date of Patent: Dec. 31, 2024

(54) SNACK-N-PLAY 3-N-1UNIT FOR BABIES AND TODDLERS

(71) Applicant: Alexander Martin, Decatur, IL (US)

(72) Inventor: Alexander Martin, Decatur, IL (US)

( * ) Notice: Subject to any disclaimer, the term of this patent is extended or adjusted under 35 U.S.C. 154(b) by 386 days.

(21) Appl. No.: 17/225,623

(22) Filed: Apr. 8, 2021

(65) Prior Publication Data

US 2022/0322853 A1 Oct. 13, 2022

(51) Int. Cl.
*A47G 19/22* (2006.01)
*A63H 5/00* (2006.01)

(52) U.S. Cl.
CPC ..... *A47G 19/2227* (2013.01); *A63H 5/00* (2013.01); *A47G 2019/2238* (2013.01); *A47G 2019/2244* (2013.01)

(58) Field of Classification Search
CPC ..... A47G 19/2227; A47G 19/2205; A47G 19/22; A47G 19/2255; A47G 19/2266; A47G 2019/2238; A47G 2019/2244
See application file for complete search history.

(56) References Cited

U.S. PATENT DOCUMENTS

| | | | | | |
|---|---|---|---|---|---|
| 4,950,196 | A * | 8/1990 | Fortune | A63H 3/005 | 428/7 |
| 5,842,901 | A * | 12/1998 | Montgomery | A61J 9/00 | 215/11.1 |
| 2006/0061985 | A1* | 3/2006 | Elkins | A47G 19/2227 | 362/253 |
| 2015/0102028 | A1* | 4/2015 | Carrasca | B65D 21/0228 | 220/288 |
| 2016/0120347 | A1* | 5/2016 | Ballard | A47G 23/0216 | 220/560 |
| 2021/0212485 | A1* | 7/2021 | Attar | A47G 19/2227 | |
| 2021/0386226 | A1* | 12/2021 | Wood | A47G 19/2227 | |

* cited by examiner

*Primary Examiner* — Javier A Pagan

(57) ABSTRACT

The "SNACK-N-PLAY for Babies and Toddlers" is an apparatus for holding food/drink and providing entertainment. It is comprised of a plurality of interchangeable nutrition delivery receptacles that connect to a unit centered between any two of said receptacles. One of said receptacles may be a baby bottle with a nipple, another of said receptacles may be a sippy cup, and yet another of said receptacles may be a snack container. Any combination of said receptacles—including duplicates—may be connected to the central unit. The central unit also features a toy that is attached via hook and loop fastener as well as music and LED lights that are powered by 3 AAA batteries that are secured within the base of the central unit via a screw-on lid. The SNACK-N-PLAY will keep babies/infants more entertained and well-fed/hydrated than traditional, individual bottles/sippy cups and/or snack containers at daycare facilities and during long commutes or other long trips.

3 Claims, 5 Drawing Sheets

SNACK-N-PLAY 3-N-1UNIT FOR BABIES AND TODDLERS

BACKGROUND OF THE INVENTION

The SNACK-N-PLAY addresses the pervasive challenge of keeping babies/infants entertained and well-fed/hydrated during long commutes, long road trips, long days at daycare facilities. etc. The SNACK-N-PLAY answers this challenge via a plurality of interchangeable nutrition delivery receptacles that are attached to a central unit. The central unit also features LED lights, music, and a removable toy that is connected to the central unit via hook and loop fastener.

Figure 1:
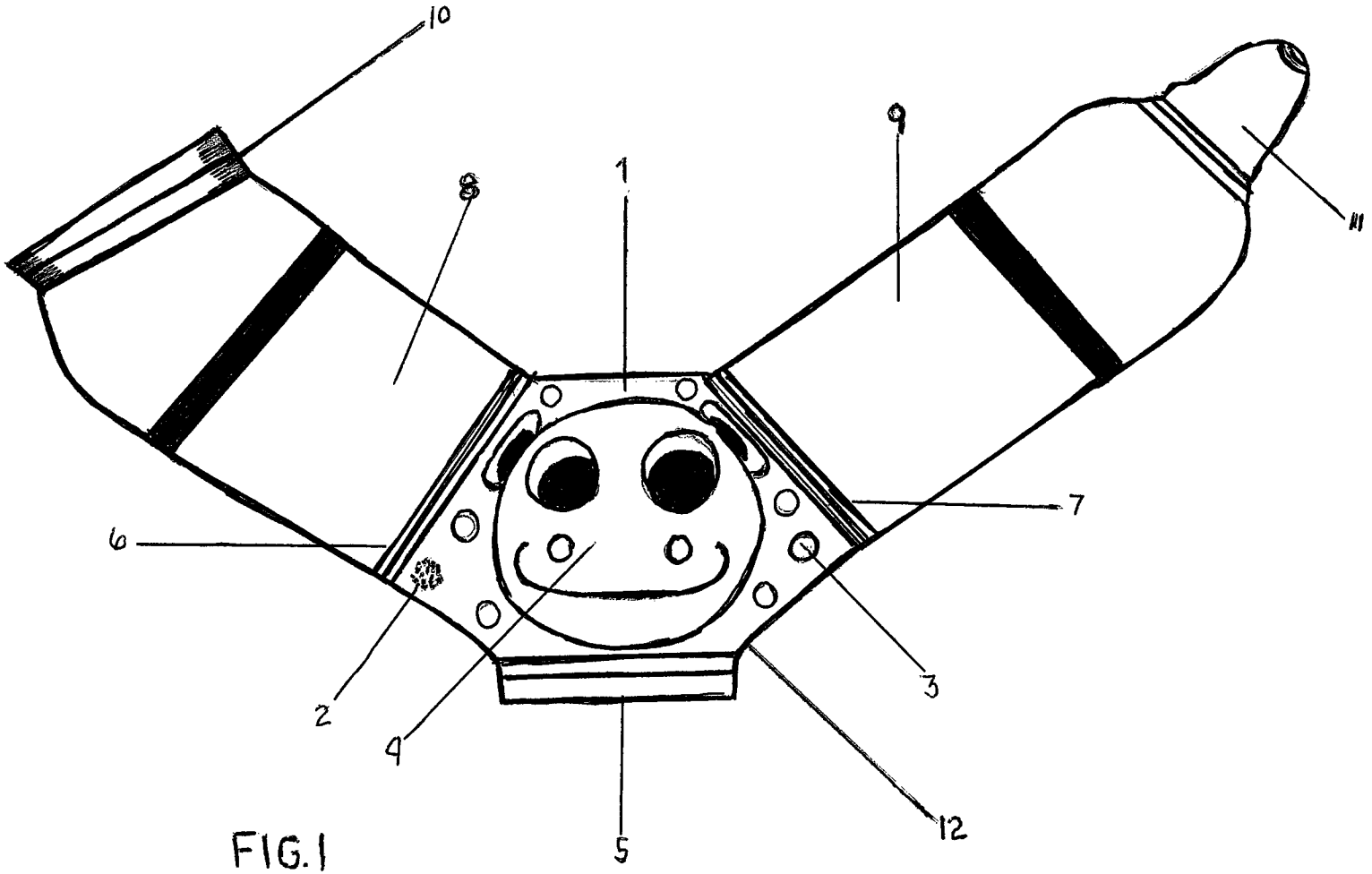

FIG. 1: front view of unit standing upright (1-12)

Figure 2:
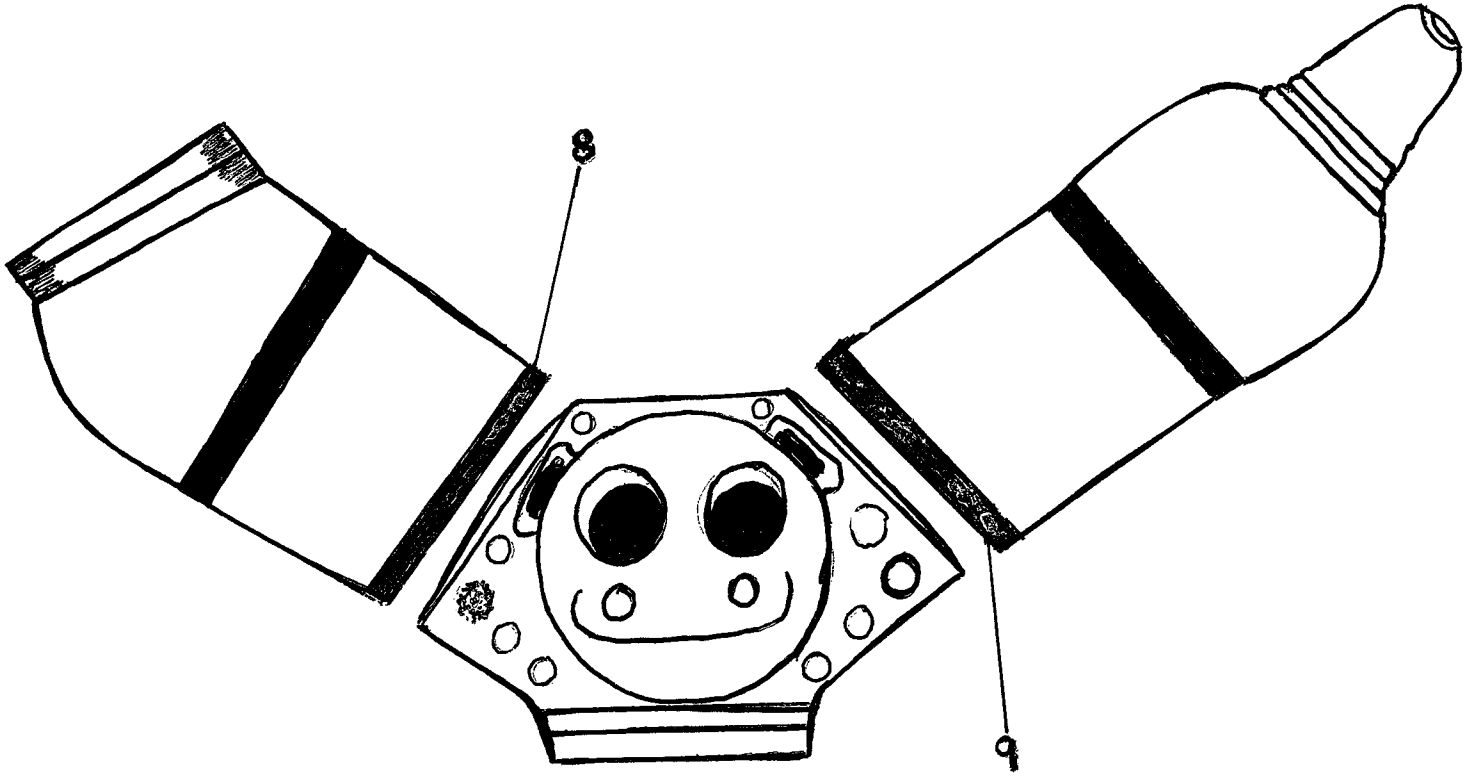

FIG. 2: exploded view of FIG. 1 with the three clearly delineated parts: the central unit and two nutrition delivery receptacles: in this case, a snack food container (8) and a baby bottle (9).

Figure 3:
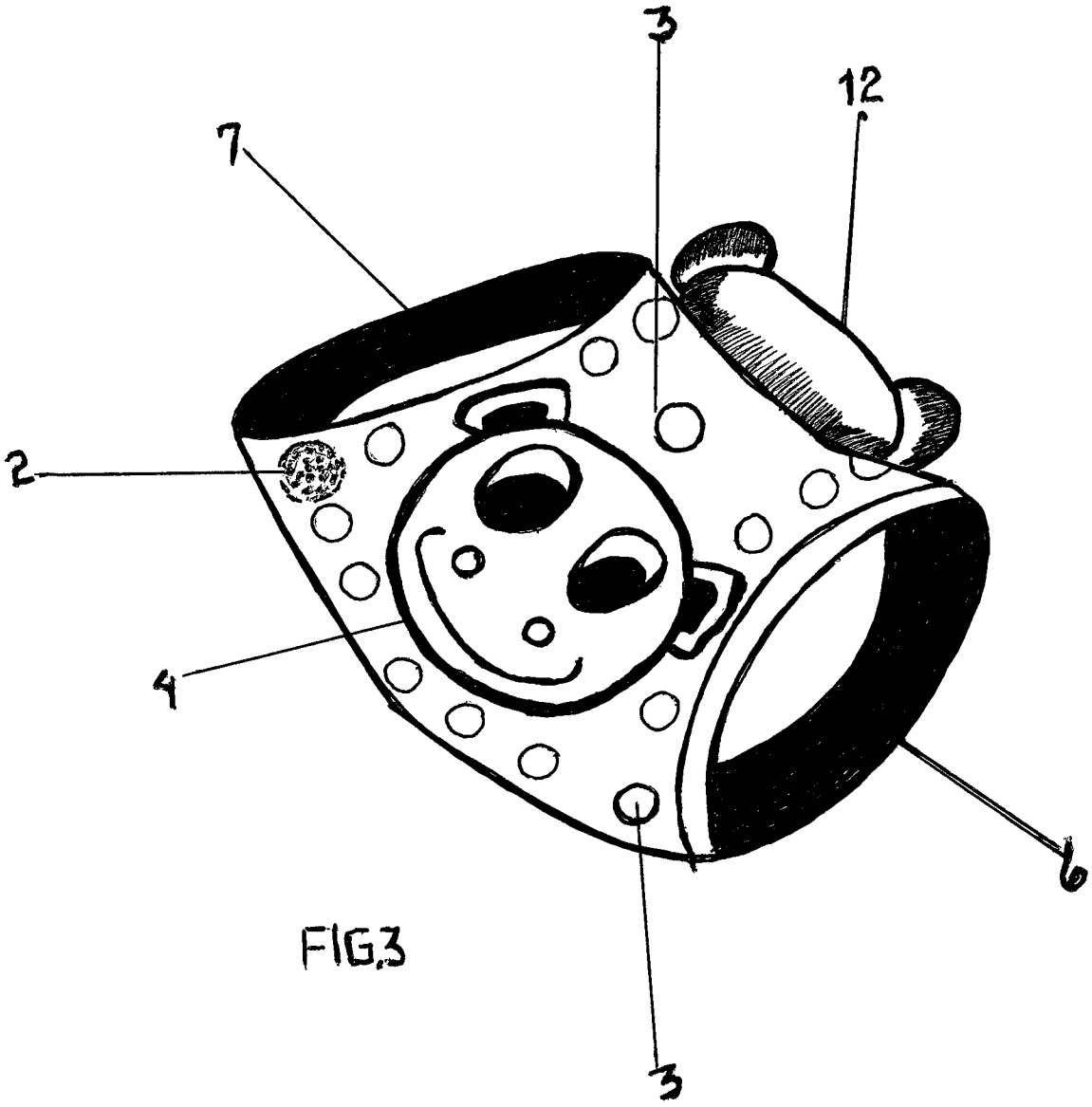

FIG. 3: angled, zoomed-in view of the central unit (2-4, 6, 7, 12)

Figure 4:
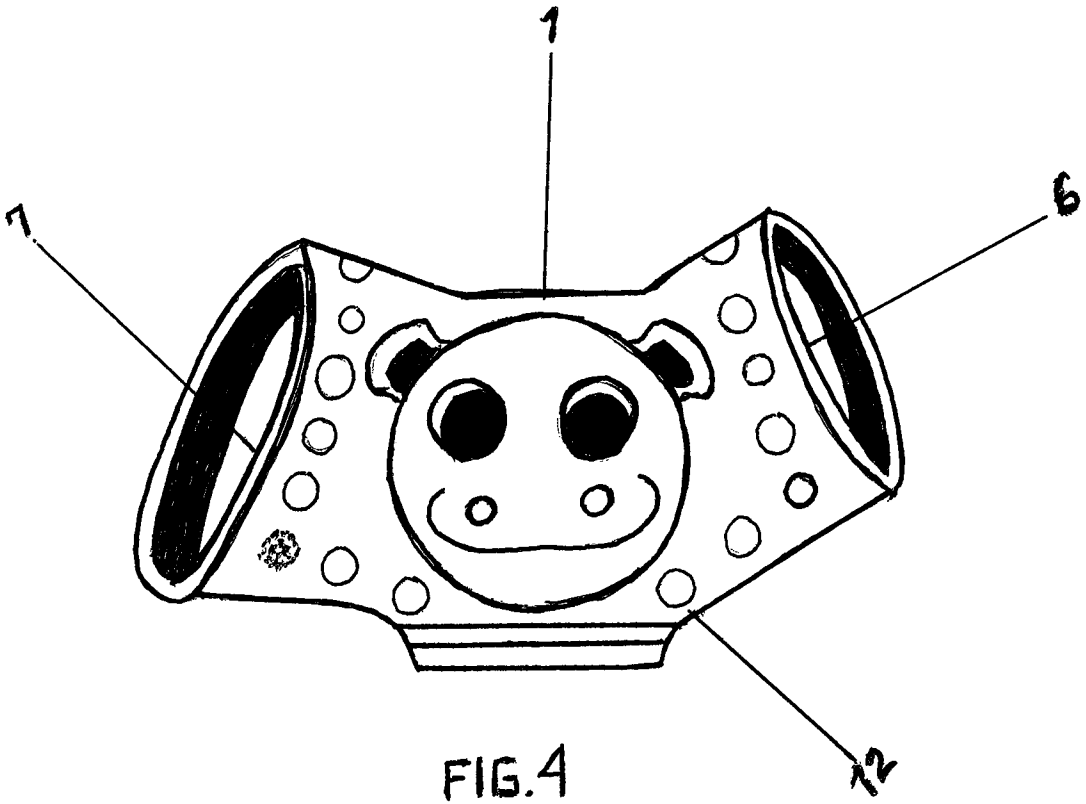

FIG. 4: front, zoomed-in view of the central unit (1, 6, 7)

Figure 5:
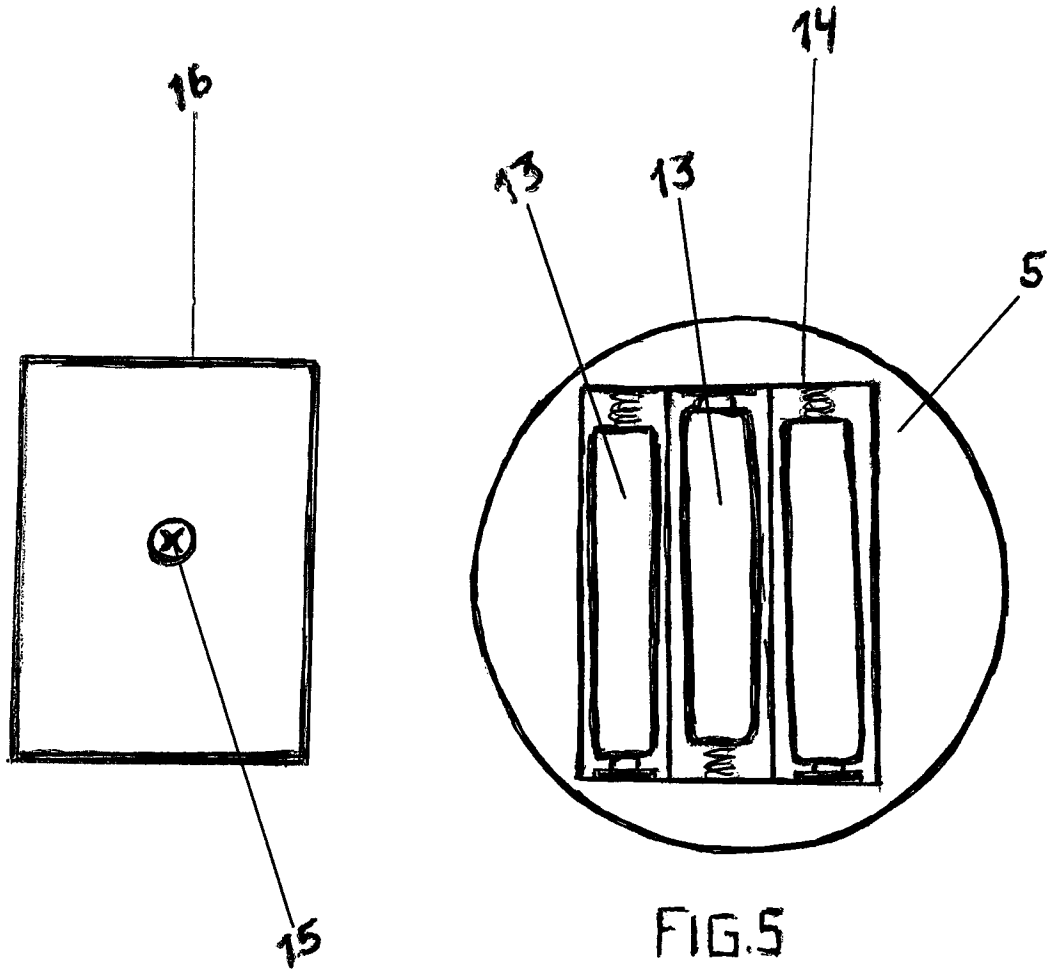

FIG. 5: battery compartment (5, 13-16)

SHEET 1

1. Central Unit
2. Speaker for musical entertainment
3. Blinking or steady lights of different colors
4. Toy attachment on the front of the central unit.
5. Flat base with 3-AAA batteries and screw-on lid
6. Left, twist-and-lock port of central unit for connecting bottle, sippy cup, or snack container
7. Right, twist-and-lock port of central unit for connecting bottle, sippy cup, or snack container
8. Left side bottle, sippy cup, or container
9. Right side bottle, sippy cup, or container
10. Left side snack container top
11. Right side bottle top with leak-proof nipple
12. Toy attachment on opposing side of central unit (not shown)

Sheet 2
8. Left side disconnected bottle, sippy cup, or container
9. Right side disconnected bottle, sippy cup, or container Sheet 3
2. Speaker
3. Blinking or steady lights on the sides of the central unit
3. Blinking or steady lights at the top of the central unit
4. Attachable toy on front side of central unit
6. Left, twist-and-lock port of central unit for connecting bottle, sippy cup, or snack container
7. Right, twist-and-lock port of central unit for connecting bottle, sippy cup, or snack container
12. Attachable toy on rear side of central unit Sheet 4
1. Front of central unit
6. Left, twist-and-lock port of central unit for connecting bottle, sippy cup, or snack container
7. Right, twist-and-lock port of central unit for connecting bottle, sippy cup, or snack container
12. Attachable toy on the rear side of the central unit (not shown)

Sheet 5
5. compartment for 3-AAA batteries to operate speaker and lights
13. battery
13. battery
14. terminal connections for batteries in central unit

15. screw to secure battery compartment lid
16. battery compartment lid

DETAILED DESCRIPTION

The SNACK-N-PLAY Invention (shown assembled in FIG. 1; exploded view in FIG. 2) consists of a central unit (FIGS. 1-3: 1) with a speaker (FIGS. 1 and 3: 2), LED lights (FIGS. 1 and 3: 3), and an attachable toy, via hook and loop fastener (FIGS. 1 and 3: 4—front view; 12—rear view) for entertaining an infant/toddler. The central unit, which can stand on a flat base (FIGS. 1 and 5: 5), can be connected to the bases (FIGS. 1, 3, and 4: 6,7) of interchangeable, nutrition delivery receptacles such as baby bottle(s), sippy cup(s), and/or snack food container(s), mixed and matched in any combination of two receptacles (FIGS. 1 and 2: 8,9) via a twist-and-lock mechanism, as with a standard, child-proof, pill bottle top. The twist-and-lock mechanism of the central unit can accommodate nutrition delivery receptacles (FIGS. 1, 3, and 4: 6,7) of standard base diameters, that is between 2-4 inches. The lid of the snack container (FIG. 1: 10) and the lid of the bottle, with standard, leak-proof nipple (FIG. 1: 11), are of standard sizes.

The speakers (FIGS. 1 and 3: 2) and LED lights (FIGS. 1 and 3: 3) are powered by 3 AAA batteries (FIG. 5: 13, 14) that are secured by a screw-on lid (FIG. 5: 15-16).

The unit is constructed mostly of plastic, except for the metallic, electronic components.

The central unit will be approximately 3 inches in length and the diameters of the twist-and-lock ports are adjustable to accommodate nutrition delivery receptacles, including bottles, cups, and snack containers, with base diameters between 2-4 inches. The dimensions of the assembled SNACK-N-PLAY unit will vary, depending on which combination of nutrition delivery receptacles are utilized.

The invention claimed is:

1. An apparatus for holding food/drink and providing entertainment, comprising: a plurality of interchangeable nutrition delivery receptacles, wherein one of said receptacles is a baby bottle with a nipple, another of said receptacles is a sippy cup, and another of said receptacles is a snack container; a central unit attachable to and centered between two of the receptacles, the central unit comprising a flat base, a first opening and a second opening, wherein the first and second openings are located on opposing sides of the central unit, the first and second openings are each angled upwards with respect to the base and wherein the first and second openings each comprise a twist-and-lock attachment mechanism, the receptacles each comprising a base with a twist-and-lock mechanism; wherein each base of the receptacles are configured to attach to the central unit via the twist-and-lock attachment mechanism, wherein when one of the said receptacles is attached to the first opening and another of said receptacles is attached to the second opening, the central unit and attached receptacles form a V-shape with respect to the base of the central unit; and the apparatus further comprising a toy which is attached, via a hook-and-loop fastener, to the central unit for entertaining an infant/toddler user.

2. The apparatus of claim 1, wherein the bases each include a flat bottom surface, wherein the flat bottom surface is configured to allow the receptacles to stand upright on counter tops or in a refrigerator.

3. The apparatus of claim 1, wherein the central unit further comprises a speaker and a plurality of LED lights; and the central unit further comprises a screw-secured battery compartment.

* * * * *